US008387407B2

(12) United States Patent
Kaspar et al.

(10) Patent No.: US 8,387,407 B2
(45) Date of Patent: Mar. 5, 2013

(54) CONDENSER FOR AN AIR CONDITIONING SYSTEM, ESPECIALLY AN AIR CONDITIONING SYSTEM OF A VEHICLE

(75) Inventors: Martin Kaspar, Fellbach (DE); Kurt Molt, Bietigheim-Bissingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 584 days.

(21) Appl. No.: 12/528,696

(22) PCT Filed: Feb. 25, 2008

(86) PCT No.: PCT/EP2008/001476

§ 371 (c)(1),
(2), (4) Date: Jan. 13, 2010

(87) PCT Pub. No.: WO2008/104349

PCT Pub. Date: Sep. 4, 2008

(65) Prior Publication Data

US 2010/0147019 A1 Jun. 17, 2010

(30) Foreign Application Priority Data

Feb. 27, 2007 (DE) ..... 10 2007 009 923

(51) Int. Cl.
*F25D 17/04* (2006.01)

(52) U.S. Cl. ..... 62/317; 62/509

(58) Field of Classification Search ..... 62/509, 62/317, 474, 244; 165/181, 119
See application file for complete search history.

(56) References Cited

U.S. PATENT DOCUMENTS

| | | | | |
|---|---|---|---|---|
| 6,517,708 | B1 * | 2/2003 | Patterson et al. | 210/96.2 |
| 7,165,417 | B2 | 1/2007 | Operschall | |
| 2002/0046569 | A1 * | 4/2002 | Faqih | 62/188 |
| 2006/0185385 | A1 * | 8/2006 | Feldhaus et al. | 62/509 |

FOREIGN PATENT DOCUMENTS

| | | | |
|---|---|---|---|
| DE | 19912381 | A1 | 9/2000 |
| DE | 10250384 | A1 | 5/2003 |
| DE | 10345921 | A1 | 5/2005 |
| DE | 102004040665 | A1 | 2/2006 |
| DE | 102005005187 | A1 | 8/2006 |
| DE | 102005023103 | A1 | 11/2006 |
| EP | 1522804 | A1 | 4/2005 |
| EP | 1703233 | A3 | 10/2008 |

OTHER PUBLICATIONS

German Search Report for DE 10 2007 009 923.3.

* cited by examiner

*Primary Examiner* — Mohammad Ali
(74) *Attorney, Agent, or Firm* — Bachman & LaPointe, P.C.

(57) ABSTRACT

The invention relates to a condenser for an air conditioning system, especially an air conditioning system of a vehicle, said condenser comprising a gill block and laterally arranged headers, the gill block comprising horizontal pipes, a condensing section and a supercooling section arranged above the condensing section. Said condenser also comprises a collector (5) arranged parallel to one of the headers and receiving a drier (16), a filter (18), a downpipe (15) and a rising pipe. The collector (5) is connected to the condensing section by means of a first overflow opening (8) and to the supercooling section by means of a second overflow opening (9) in such a way that a coolant can circulate. The downpipe (15) communicates with the first overflow opening (8), on the inlet side, by means of an inflow chamber (10) arranged in the collector (5).

24 Claims, 3 Drawing Sheets

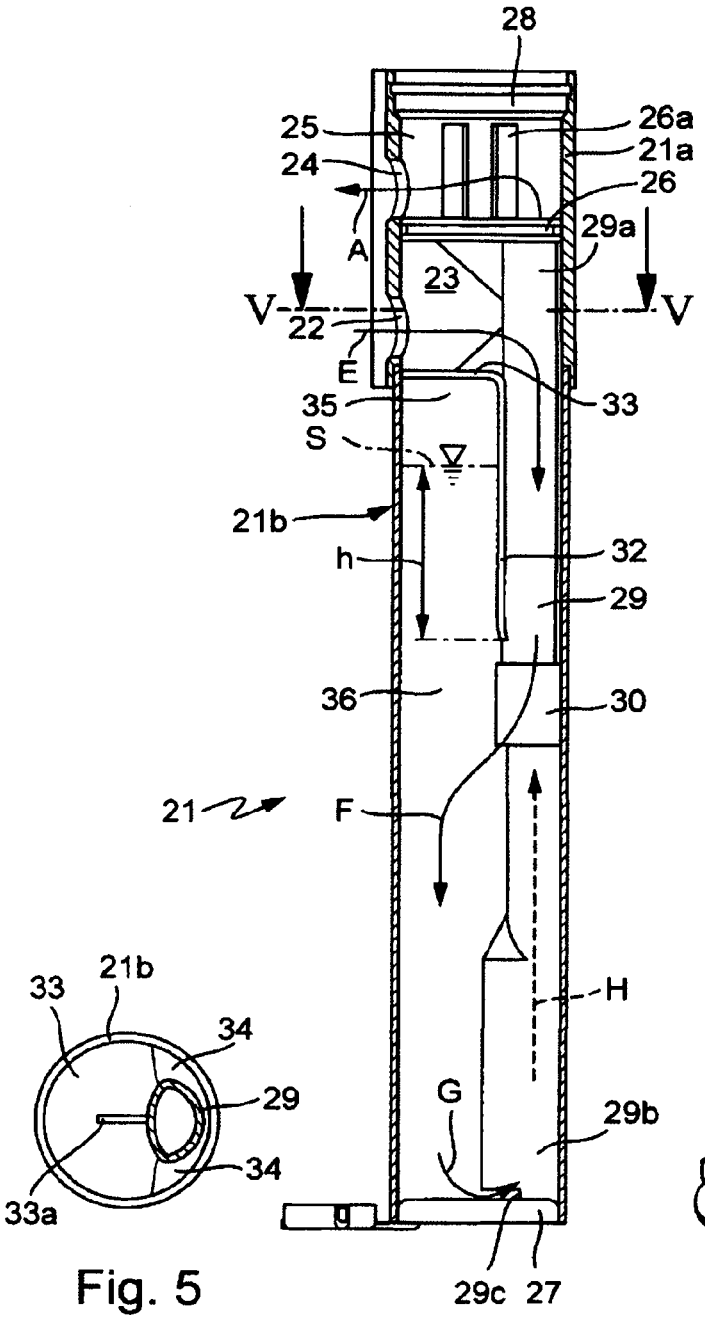
Fig. 5
Fig. 3
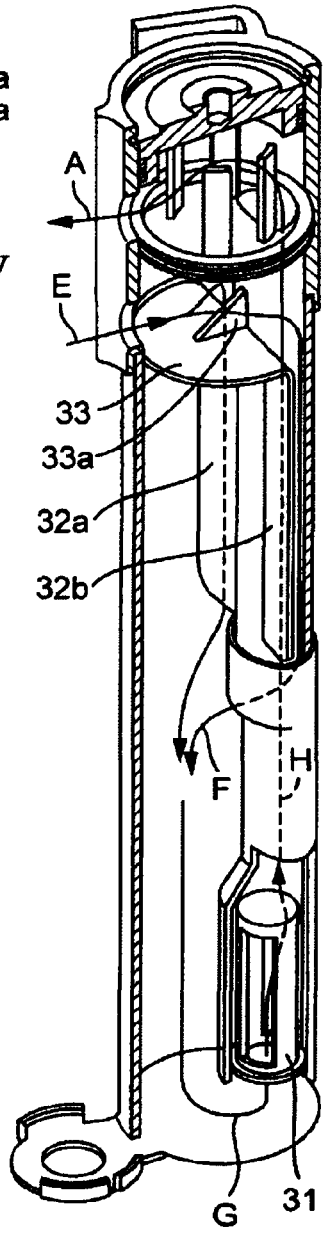
Fig. 4

CONDENSER FOR AN AIR CONDITIONING SYSTEM, ESPECIALLY AN AIR CONDITIONING SYSTEM OF A VEHICLE

BACKGROUND OF THE INVENTION

The invention relates to a condenser for an air. conditioning system.

The Applicants' prior German patent application DE 10 2005 005 187.1 relates to a refrigerant condenser having a condensing section and having a supercooling section—a so-called supercooling path—arranged above said condensing section, in which supercooling section the refrigerant is cooled to below its condensation temperature. The condenser also has laterally arranged collecting tubes and an integrated collector which communicates via a first and a second transfer opening with the adjacent collecting tube or the condenser. Arranged in the collector is an insert which has a down pipe, a filter-dryer unit and an ascending pipe, with the down pipe communicating at the inlet side with the final condensing section and with the ascending pipe communicating at the outlet side with the supercooling path. The filter-dryer unit has arranged in it a dryer material (a so-called molecular sieve) and a mechanical sieve, such that as the refrigerant passes through the filter-dryer unit, said refrigerant is firstly freed from particles such as impurities and is secondly dried. Arranged in the upper part of the collector, in the region of the transfer openings, is a plug which separates the inflowing and outflowing refrigerant flows from one another.

Similar refrigerant condensers, that is to say with an overhead supercooling path and having an ascending pipe in the collector, are known from the applicant's DE 199 12 381 A1 and from DE 102 50 384 A1 and from DE 103 45 921 A1.

SUMMARY OF THE INVENTION

It is an object of the present invention to further improve the subject matter of the applicant's above-cited prior patent application, in particular with regard to the filter-dryer function.

Said object is achieved in each case by means of the features of the two independent patent claims 1 and 14. The subclaims relate to advantageous refinements of the invention.

According to the first independent solution, an inflow chamber is arranged in the region of the first transfer opening (inflow opening) and an outflow chamber is arranged in the region of the second transfer opening (outflow opening), which inflow chamber and outflow chamber are delimited firstly by the cylindrical wall of the collector and secondly by two plates or partitions and a closure part. This provides the advantage that the guidance of the refrigerant in the inflow and outflow region is simplified; for example, a corresponding plug, which is provided in said region in the prior application, is dispensed with.

In one advantageous refinement of the invention, the down pipe adjoins the inflow chamber in the downward direction, through which down pipe the refrigerant flow which enters from the condensing section is channeled and directed downward in terms of its flow direction, that is to say in the direction of the base of the collector. The down pipe ends at a significant distance above the base. This provides the advantage that the downwardly emerging refrigerant flow is decelerated as a result of the sudden cross-sectional widening, as a result of which entrained gas bubbles are separated and can rise up. Said gas bubbles collect in a space below the inflow chamber.

In a further advantageous refinement of the invention, a dryer element is arranged on the base in the collector, which dryer element is preferably designed as a nonwoven bag containing dryer granules and extends upward up to below the inflow chamber. The refrigerant flow emerging from the down pipe can therefore make contact with the dryer material, as a result of which water is extracted from the refrigerant.

In a further advantageous refinement of the invention, an ascending pipe or suction pipe which runs continuously from the base up to the outflow chamber is arranged in the collector, through which ascending pipe or suction pipe the refrigerant is conducted from the bottom to the top into the outflow chamber. The ascending pipe is advantageously widened in its lower cross-sectional region and holds within it a filter element, preferably designed as a filter cap, in a positively locking or non-positively locking fashion. This provides a simple, exchangeable and space-saving arrangement of the filter element within the suction pipe, together with an effective filter action. At the same time, the filter and dryer element are therefore physically separated, which allows them to be exchanged more easily.

In a further advantageous refinement of the invention, the down pipe and the ascending pipe are formed in one piece with one another and have a doubled cross section, characterized by a common partition. It is also optionally possible for the lower and upper plates to be formed in one piece with the ascending pipe and down pipe, such that, in the case of a design as a plastic injection-molded part, an insert is provided which is easy to handle and which is inserted into the collector and secured by means of a closure part. Assembly—or if appropriate also disassembly—can therefore take place with one or two hand movements.

In the second independent solution, the down pipe of the first solution is replaced by a flow duct which is formed by a partition insert, the outer wall of the ascending pipe and the inner wall of the collector, so as to form two injection ducts. This provides the advantage of better volume utilization of the collector: it is possible in particular for more drying agent to be accommodated in the storage space. Furthermore, the entire insert can be produced more easily, and with less material expenditure, by injection molding.

BRIEF DESCRIPTION OF THE DRAWINGS

Exemplary embodiments of the invention are illustrated in the drawing and are described in more detail below. In the drawing:

FIG. 3 shows a further modified collector in a sectional illustration, FIG. 4 shows the collector according to FIG. 3 in a 3-D illustration, and FIG. 5 shows a section along the line V-V in FIG. 3.

DETAILED DESCRIPTION

Figure 1:
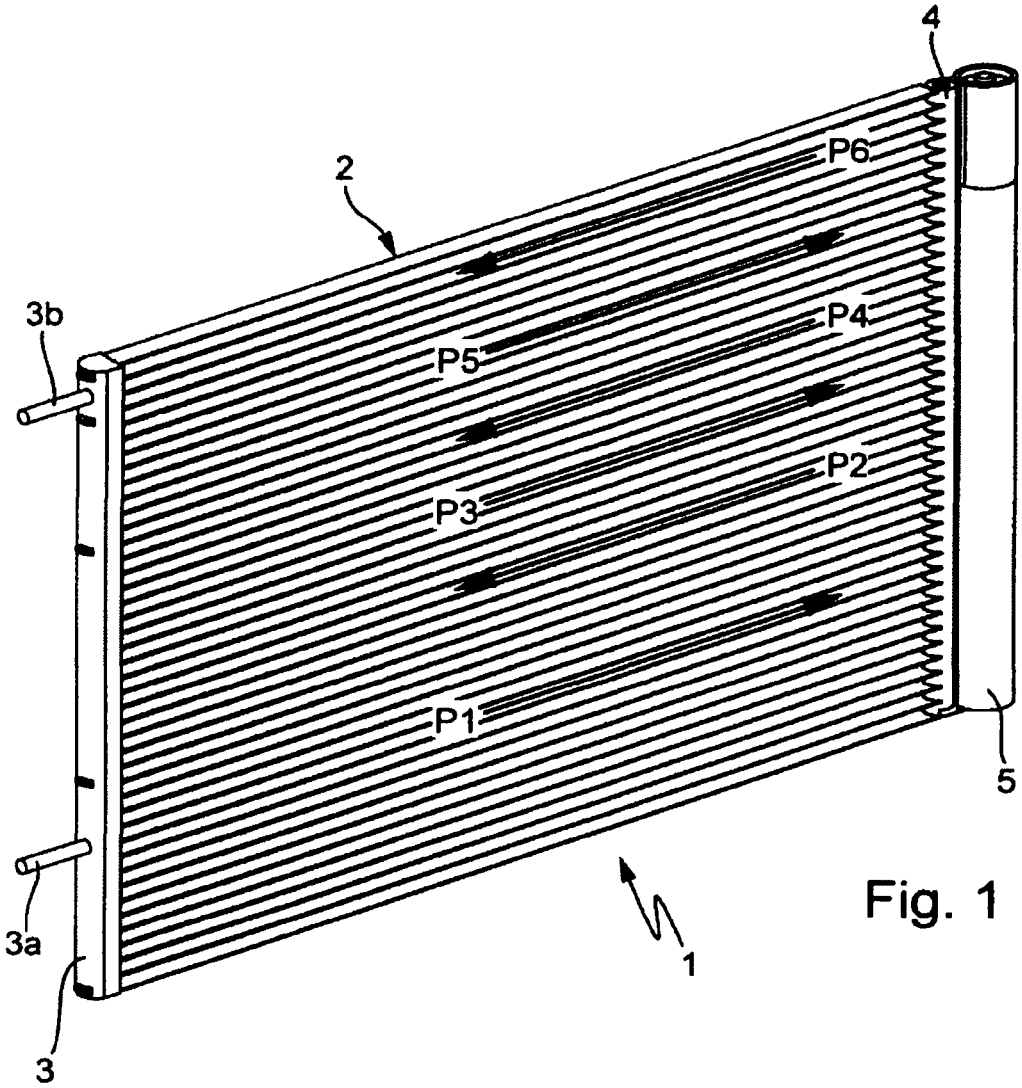
FIG. 1 shows a cross-flow condenser with an overhead supercooling path and a laterally arranged integrated collector.

FIG. 1 shows a cross-flow condenser 1 which can be traversed by a plurality of flows and which has a tube-fin block 2, laterally arranged collecting tubes 3, 4 and an integrated collector 5. The arrows P1, P2, P3, P4, P5 and P6, which point in alternating directions, represent the flow directions of the refrigerant in individual tube groups (not illustrated in any more detail) of the tube-fin block 2, with the refrigerant entering via a connecting pipe 3*a* situated at the bottom and emerging via a connecting pipe 3*b* situated at the top. The tube-fin block 2 is composed of a condensing section, which corresponds to the arrows P1 to P5, and a supercooling section which is arranged above the condensing section and which is denoted by the arrow P6. Substantially liquid refrigerant flows in the supercooling section, which refrigerant is cooled to below the condensation temperature of the refrigerant by the ambient air which impinges on the condenser 1. The refrigerant subsequently leaves the condenser 1 via the connecting pipe 3*b*.

Figure 2:
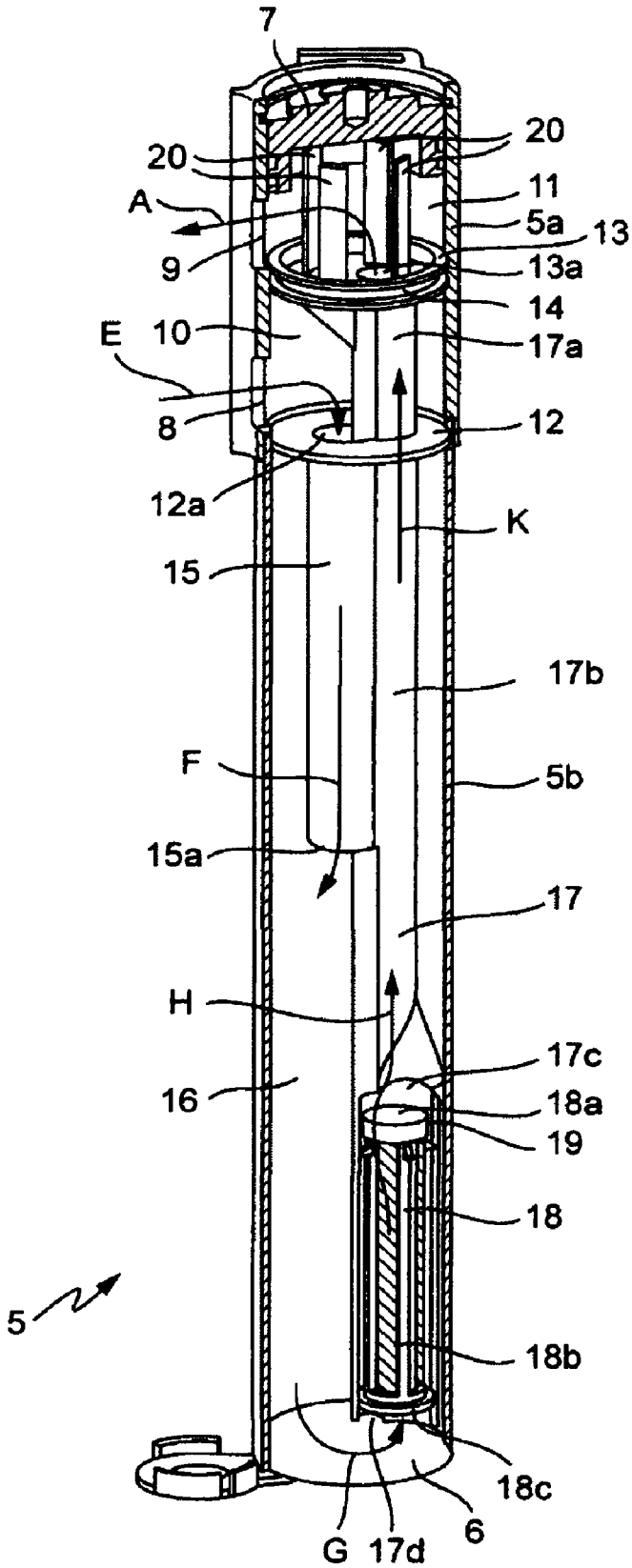
FIG. 2 shows the collector in a sectional illustration.

FIG. 2 shows—as a first exemplary embodiment of the invention—the collector 5 in a sectional illustration, without the adjacent collecting tube 4. The collector 5 is composed of two pipe pieces, an upper, extruded pipe piece 5*a*, and a lower, welded pipe piece 5*b* which is cohesively connected to the upper pipe piece 5*a*. The collector 5 is closed off in the downward direction by a base 6 (non-detachable) and in the upward direction by a closure plug 7 (detachable). The extruded pipe piece 5*a* has a first transfer opening (inflow opening) and a second transfer opening 9 (outflow opening), through which refrigerant flows in from the adjacent collecting tube (not illustrated) corresponding to the arrow E, and flows out corresponding to the arrow A. The design and the arrangement of the adjacent collecting tube 4 (not illustrated) correspond to the prior patent application with the file reference 10 2005 005 187.1 cited in the introductory part of the description, the entire content of which is hereby incorporated into the content of disclosure of the present application. An inflow chamber 10 for the refrigerant is arranged in the region of the inflow opening 8 and an outflow chamber 11 for the emerging refrigerant is arranged in the region of the outflow opening 9, with the inflow chamber 10 being delimited in the axial direction by a lower plate 12 and by an upper plate 13 which is arranged as a partition between the two transfer openings 8, 9. The outflow chamber 11 is formed by the upper plate 13, which has an encircling sealing ring 14, and by the detachable closure plug 7. The lower plate 12 has, in its central region, an inlet opening 12*a* which is adjoined in the downward direction by a down pipe 15 which has a lower outlet opening 15*a*. A dryer element, designed as a nonwoven bag 16 filled with dryer granules, is arranged below the inflow chamber 10 so as to rest on the base 6. The nonwoven bag 16 is designed corresponding to the installation conditions, that is to say in this case has an elongate shape which extends in the longitudinal direction of the collector and which provides sufficient space for the refrigerant flow emerging from the down pipe 15 to flow around the nonwoven bag 16. Refrigerant is stored in the collector 5, which refrigerant is present in a liquid and gaseous phase; the liquid level should lie above the outlet opening 15*a* of the down pipe 15.

An ascending pipe 17 is connected, preferably in one piece, to the down pipe 15, which ascending pipe 17 extends in the longitudinal direction of the collector 5 from the base 6 to the upper plate 13. The latter has an outlet opening 13*a* which is adjoined by the upper end 17*a* of the ascending pipe 17. The ascending pipe 17 extends with its upper region 17*a* through the inflow chamber 10 and the plate 12 and, with its central region 17*b*, forms a doubled cross section together with the adjacent down pipe 15, that is to say two cross sections, which are separated by a common partition, for the refrigerant flowing in opposite directions. The lower region 17*c* of the ascending pipe 17 is widened in terms of its cross section and holds within it —as can be seen from the drawing—a cylindrical filter element which is designed as a so-called filter cap 18. An annular gap 19 is provided between the cylindrical filter cap 18 and the cylindrical section 17*c* of the ascending pipe 17. The filter cap 18 has window-like filter sieves 18*b* (particle filters) on its cylindrical circumference, is closed off at its upper face-side end 18*a* and is open at the opposite end 18*c*. The ascending pipe 17 stands with its lower face end on the base 6 and has an aperture 17*d* as an inlet for refrigerant. Four approximately circumferentially distributed, rod-shaped spacers 20 are arranged on the upper side of the upper plate 13 and are connected to the plate 13—said spacers 20 abut with their upper ends against the underside of the closure plug 7 and thereby fix the plate 13 in the upward direction. The ascending pipe 17, the down pipe 15, the lower plate 12, the upper plate 13 and the spacers 20 are preferably produced in one piece as a plastic injection-molded part and thereby form an insert which can be inserted into the collector 5 from above when the closure plug 7 is removed. The nonwoven bag 16 is also inserted either at the same time as or before the insert. The closure plug 7 is then inserted and fixed so as to form an upper stop for the entire insert with ascending pipe 17.

The function of the dryer and filter device according to the invention will be described below: the substantially condensed refrigerant passes, corresponding to the arrow E (analogously to the cited prior application), into the inflow chamber 10 and flows downward through the inlet opening 12*a* and the down pipe 15 in the direction of an arrow F. As the refrigerant emerges from the outlet opening 15*a*, which is immersed in liquid refrigerant, the flow speed of the refrigerant is slowed on account of the cross-sectional widening, such that entrained gas bubbles are separated and can rise upward. As a result of the flow guidance in the down pipe 15, therefore, the liquid refrigerant does not come into contact with the gas phase. The refrigerant flows further downward and, here, makes contact with the nonwoven bag 16 and the dryer granules contained therein, as a result of which moisture is extracted from the refrigerant. Having arrived at the base 6 of the collector 5, the refrigerant is deflected corresponding to an arrow G and enters into the filter cap 18 through the lower opening 18*c* in the axial direction. The refrigerant then flows outward in the radial direction through the window-like sieves 18*b* into the annular gap 19, with any entrained particles being retained by the sieves 18*b* and falling down onto the base 6. The refrigerant rises up, corresponding to an arrow H, into the central region 17*b* and further into the upper region 17*a* of the ascending pipe 17. The refrigerant leaves the collector 5 via the outlet opening 13*a* in the upper plate 13, corresponding to the arrow A, and enters via the adjacent collecting tube (not illustrated) into the upper supercooling section (likewise not illustrated) of the condenser.

FIGS. 3, 4 and 5 show a second exemplary embodiment of the invention having a collector 21 which—as in the preceding exemplary embodiment—is composed of two pipe pieces, an upper, extruded pipe piece 21*a* and a lower, welded pipe piece 21*b*. An inflow opening 22, which communicates with an inflow chamber 23, and an outflow opening 24, which communicates with an outflow chamber 25, are situated in the upper pipe piece 21*a*. The inflow chamber 23 and outflow chamber 25 are separated from one another by means of a partition 26 which is formed as a disk, is sealed off at its circumference and has spacers 26*a*. The collector 21 is closed off in the downward direction by a base 27 and in the upward direction by a detachable closure plug 28. A flow duct which is designed as an ascending pipe 29 is arranged in the collector 21 for refrigerant flowing from the base 27 into the outflow chamber 25. The ascending pipe 29 stands on the base 27 and extends upward, that is to say in the longitudinal direction of the collector 21, up to the partition 26 which holds the upper end 29*a* of the ascending pipe 29. The lower end 29*b* has a step 29*c* for the inlet of the refrigerant. In the central region, the ascending pipe 29 has a sleeve 30 which enables the ascending pipe 29 to be produced in one piece. As can be seen from FIG. 4, a filter element 31 is arranged in the lower region of the ascending pipe 29, which filter element 31 corresponds to the filter element 18 according to the exemplary embodiment of FIG. 2, that is to say in terms of form, arrangement and function.

In contrast to the first exemplary embodiment according to FIG. 2, a flow duct for inflowing refrigerant is provided, which flow duct is formed not by a closed pipe cross section (in the form of a down pipe) but rather by a partition insert 32, the outer wall of the ascending pipe 29 and the inner wall of the pipe piece 21*b*. The partition insert 32 is composed of two partition strips 32*a*, 32*b* which abut with their inner longitudinal edges against the ascending pipe 29 and with their outer longitudinal edges against the inner wall of the collector 21. The partition strips 32*a*, 32*b* are connected to a base part 33 which delimits the inflow chamber 23 in the downward direction (in the direction of the base 27) but which leaves free two throughflow cross sections for the inflowing refrigerant at both sides of the ascending pipe 29, which throughflow cross sections form the inlet into two injection ducts 34 (cf. FIG. 5). The partition strips 32*a*, 32*b* and the base part 33 are preferably formed in one piece and connected to the ascending pipe 29, inter alia by means of a web 33*a*. Arranged below the base part 33, that is to say on the side facing away from the inflow chamber 23, is a storage space 35 in which in particular the gaseous phase of the refrigerant can collect. The liquid level S of the refrigerant, that is to say the parting plane between the liquid and gaseous phase, is situated in the region of the partition strips 32*a*, 32*b*. A dryer element in the form of a nonwoven bag 36 filled with granules is arranged within the storage space 35 which extends from the base part 33 to the base 27 of the collector 21.

FIG. 5 shows a cross section corresponding to the plane V-V, showing the base part 33 and the injection ducts 34 arranged at both sides of the ascending pipe 29. The cross section of the injection pipe 29 is slightly flattened, so as to provide a good utilization of space within the round cross section of the collector 21 for the injection ducts 34 and secondly to make a sufficiently large cross section available for the storage space 35, in particular for accommodating the drying agent 36.

The ascending pipe 29, the base part 33 with the partition insert 32 and the partition 26 with spacers 26*a* may preferably be produced in one piece as a plastic injection-molded part and thereby form an insert which—together with the nonwoven bag 36—can be inserted into and fixed in the collector 21.

The function of the above-described collector is, in principle, the same as that of the preceding exemplary embodiment according to FIG. 2. What is different is—as already mentioned—the geometric design of the flow duct which adjoins the inflow chamber 23 and leads downward. The down pipe 15 according to FIG. 2 is substituted here by the injection ducts 34. The refrigerant which flows in as per the arrow E thus flows downward through the two injection ducts 34, following the arrow F, with moisture being extracted from the refrigerant by the granules. The refrigerant enters into the ascending pipe 29 through the opening 29*c* at the base 27 corresponding to the arrow G, and flows upward corresponding to the dashed arrow H into the outflow chamber 25, from which the refrigerant emerges corresponding to the arrow A.

By means of the injection ducts 34, it is ensured that the inflowing refrigerant does not come into contact with any gas cushion which may be situated in the upper part of the storage space 35, but rather is conducted so far downward that the entering refrigerant flow opens out directly into the liquid phase of the refrigerant. The liquid level S is shown by way of example in the storage chamber 35, which liquid level S has a geodetic height h over the lower edge of the partition strips 32*a*, 32*b*. The level S may vary during the operation of the air conditioning system, that is to say said level S may lie higher or lower. The length of the injection ducts 34 should however be dimensioned such that the height h is always positive, that is to say the lower edges of the partition strips 32*a*, 32*b* are immersed in liquid refrigerant.

The invention claimed is:

1. A condenser for an air conditioning system of a motor vehicle, having a tube/fin block and having laterally arranged collecting tubes, with the tube/fin block having horizontally running tubes, a condensing section and a supercooling section arranged above the condensing section, and having a collector which is arranged parallel to one of the collecting tubes and which holds a dryer, a filter, a down pipe and an ascending pipe, which collector is connected with regard to refrigerant via a first transfer opening to the condensing section and via a second transfer opening to the supercooling section, with the down pipe communicating at the inlet side with the first transfer opening via an inflow chamber which is arranged in the collector, wherein the inflow chamber is delimited by a lower plate and an upper plate, and wherein the down pipe extends downwardly from an opening in the lower plate.

2. The condenser as claimed in claim 1, wherein the collector has a base and a dryer element is arranged between the inflow chamber and the base.

3. The condenser as claimed in claim 2, wherein the dryer element is designed as a nonwoven bag which can be filled with dryer granules.

4. The condenser as claimed in claim 1, wherein an outflow chamber is arranged in the collector above the inflow chamber, which outflow chamber is delimited by the upper plate and by a closure part.

5. The condenser as claimed in claim 4, wherein the ascending pipe has a length extending from the base to the outflow chamber.

6. The condenser as claimed in claim 1, wherein the down pipe and the ascending pipe are connected to one another.

7. The condenser as claimed in claim 6, wherein the down pipe and the ascending pipe are formed in one piece and have a doubled cross section over the region of a common length.

8. The condenser as claimed in claim 1, wherein the ascending pipe has a lower region in which the filter element is held.

9. The condenser as claimed in claim 8, wherein the filter element is formed as a filter cap into which flow can enter axially and out of which flow can exit radially.

10. The condenser as claimed in claim 9, wherein the filter cap is held and can be fixed in the ascending pipe in a positively locking and/or non-positively locking fashion.

11. The condenser as claimed in claim 9, wherein in the region of the filter cap, the ascending pipe has a widened cross section and, together with the filter cap, forms an annular gap.

12. The condenser as claimed in claim 1, wherein the down pipe, the ascending pipe, the lower and upper plates can be produced in one or more pieces from plastic.

13. The condenser as claimed in claim 6, wherein the down pipe and the ascending pipe are connected to one another along side walls thereof.

14. A condenser for an air conditioning system of a motor vehicle, having a tube/fin block and having laterally arranged collecting tubes, with the tube/fin block having horizontally running tubes, a condensing section and a supercooling section arranged above the condensing section, and having a collector which is arranged parallel to one of the collecting tubes and which comprises a dryer, a filter, a first flow duct for inflowing refrigerant and a second flow duct for outflowing refrigerant, which collector is connected with regard to refrigerant via a first transfer opening to the condensing section and via a second transfer opening to the supercooling section, with the first flow duct communicating at the inlet side with the first transfer opening via an inflow chamber which is arranged in the collector, wherein the second flow duct is an ascending pipe, and wherein the first flow duct has a flow cross section which is formed by the inner wall of the collector, by the outer wall of the ascending pipe and by a partition insert.

15. The condenser as claimed in claim 14, wherein the partition insert adjoins a base part which separates the inflow chamber.

16. The condenser as claimed in claim 14, wherein the partition insert is angled from the base part at approximately right angles and is formed preferably in one piece with the base part.

17. The condenser as claimed in claim 16, wherein the partition insert has two partition strips which serve to form two injection ducts.

18. The condenser as claimed in claim 14, wherein the partition insert and/or the base part are fastened to or formed in one piece with the ascending pipe.

19. The condenser as claimed in claim 14, wherein a storage space for liquid and gaseous refrigerant is arranged below the inflow chamber, in particular below the base part.

20. The condenser as claimed in claim 19, wherein the dryer is arranged in the storage space.

21. The condenser as claimed in claim 20, wherein the dryer is designed as a nonwoven bag which can be filled with dryer granules.

22. A condenser for an air conditioning system of a motor vehicle, having a tube/fin block and having laterally arranged collecting tubes, with the tube/fin block having horizontally running tubes, a condensing section and a supercooling section arranged above the condensing section, and having a collector which is arranged parallel to one of the collecting tubes and which comprises a dryer, a filter, a first flow duct for inflowing refrigerant and a second flow duct for outflowing refrigerant, which collector is connected with regard to refrigerant via a first transfer opening to the condensing section and via a second transfer opening to the supercooling section, with the first flow duct communicating at the inlet side with the first transfer opening via an inflow chamber which is arranged in the collector, wherein a storage space for liquid and gaseous refrigerant is arranged below the in flow chamber below the base part, and wherein the upper part of the storage space is separated from the injection ducts by the partition insert or the partition strips.

23. A condenser for an air conditioning system of a motor vehicle, having a tube/fin block and having laterally arranged collecting tubes, with the tube/fin block having horizontally running tubes, a condensing section and a supercooling section arranged above the condensing section, and having a collector which is arranged parallel to one of the collecting tubes and which comprises a dryer, a filter, a first flow duct for inflowing refrigerant and a second flow duct for outflowing refrigerant, which collector is connected with regard to refrigerant via a first transfer opening to the condensing section and via a second transfer opening to the supercooling section, with the first flow duct communicating at the inlet side with the first transfer opening via an inflow chamber which is arranged in the collector, wherein the condenser further comprises a partition insert which defines the first flow duct within the collector, and wherein a storage space for liquid and gaseous refrigerant is arranged below the in flow chamber below the base part, and wherein the ascending pipe, the partition insert, the base part and/or the partition are designed as an insert.

24. The condenser as claimed in claim 23, wherein the insert is a single-piece plastic injection-molded part.

* * * * *

UNITED STATES PATENT AND TRADEMARK OFFICE

CERTIFICATE OF CORRECTION

PATENT NO. : 8,387,407 B2
APPLICATION NO. : 12/528696
DATED : March 5, 2013
INVENTOR(S) : Martin Kasper et al.

It is certified that error appears in the above-identified patent and that said Letters Patent is hereby corrected as shown below:

In the Claims

Claim 1, column 6, line 18, delete "which is".

Claim 1, column 6 line 19, delete "which holds" and insert --holding--.

Claim 1, column 6 line 20, delete "which" and insert --wherein the--.

Claim 1, column 6 line 24, delete "which is".

Claim 1, column 6 line 26, delete "and".

Claim 1, column 6 line 28 after the word "plate" insert --and wherein the ascending pipe passes through the inflow chamber--.

Claim 3, column 6 line 33, delete "which can be".

Claim 4, column 6 line 37, delete "which" and insert --and wherein the--.

Claim 8, column 6 line 48, delete "in which" and insert --, and wherein--.

Claim 8, column 6 line 49, after the word "held" insert --in the lower region--.

Claim 9, column 6 line 51, delete "into which" and insert --wherein--.

Claim 9, column 6 line 51, after "flow" delete "can enter" and insert --enters the filter cap--.

Claim 9, column 6 line 52, delete "out of which flow can exit" and insert --exits the filter cap--.

Claim 14, column 7 line 3, delete "which is".

Claim 14, column 7 line 4, delete "and which" and insert --, wherein the collector--.

Claim 14, column 7 line 6, delete "which" and insert --wherein the--.

Claim 14, column 7 line 13, delete "which is".

Claim 17, column 7 line 24, delete "which serve to" and insert --, and wherein the two partition strips--.

Signed and Sealed this
Sixth Day of August, 2013

Teresa Stanek Rea
*Acting Director of the United States Patent and Trademark Office*

In the Claims

Claim 19, column 7 line 31, detele "in particular"

Claim 21, column 7 line 35, delete "which can be".

Claim 22, column 8 line 3, delete "which is".

Claim 22, column 8 line 4, delete "and which" and insert --, wherein the collector--.

Claim 22, column 8 line 6 delete "which" and insert --wherein the--.

Claim 22, column 8 line 10, delete "which is".

Claim 23, column 8 line 21, delete "which is"

Claim 23, column 8 line 22, delete "and which" and insert --, wherein the collector.

Claim 23, column 8 line 24, delete "which" and insert --wherein the--.

Claim 23, column 8 line 28, delete "which is".

Claim 23, column 8 line 30, delete "which" and insert --wherein the partition insert--.